United States Patent [19]

Lavon

[11] 4,204,715

[45] * May 27, 1980

[54] METHOD AND DEVICE FOR BREAKING A HARD COMPACT MATERIAL

[75] Inventor: Erik V. Lavon, Saltsjö-Boo, Sweden

[73] Assignee: Atlas Copco Aktiebolag, Nacka, Sweden

[ * ] Notice: The portion of the term of this patent subsequent to Jan. 11, 1995, has been disclaimed.

[21] Appl. No.: 852,576

[22] Filed: Nov. 17, 1977

[30] Foreign Application Priority Data

Nov. 24, 1976 [SE] Sweden ..... 7613107

[51] Int. Cl.[2] ..... E21C 37/12

[52] U.S. Cl. ..... 299/16; 175/67; 239/101; 299/29

[58] Field of Search ..... 299/16, 17; 175/67; 241/1, 5, 39; 137/604; 239/101, 102, 428, 433

[56] References Cited

U.S. PATENT DOCUMENTS

| | | | |
|---|---|---|---|
| 2,840,360 | 6/1958 | Jerusel | 299/16 X |
| 3,055,648 | 9/1962 | Lawrence et al. | 299/20 |
| 3,334,657 | 8/1967 | Smith et al. | 137/604 |
| 3,601,987 | 8/1971 | Chermensky et al. | 239/99 X |
| 3,704,966 | 12/1972 | Beck, Jr. | 299/17 X |
| 3,729,137 | 4/1973 | Cobb et al. | 299/17 X |
| 3,784,103 | 1/1974 | Cooley | 299/17 X |
| 3,868,967 | 3/1975 | Harding | 137/604 |
| 3,988,037 | 10/1976 | Denisart et al. | 299/16 |
| 4,074,779 | 2/1978 | Cheung et al. | 175/67 X |

*Primary Examiner*—Ernest R. Purser
*Assistant Examiner*—Nick A. Nichols, Jr.
*Attorney, Agent, or Firm*—Frishauf, Holtz, Goodman & Woodward

[57] ABSTRACT

A hard compact material, such as rock, is broken by driving a longish mass body of relatively incompressible fluid, such as water, against the material to be broken. The mass body is caused to impact the material at a momentum required for breaking the material. The required momentum is obtained by adding the momentum of at least two fluid mass bodies. The longish mass body can be aligned with a drill hole by means of the drill bit and rod. The energy generator or fluid gun and the gun barrel can be made in separable units.

70 Claims, 8 Drawing Figures

METHOD AND DEVICE FOR BREAKING A HARD COMPACT MATERIAL

BACKGROUND OF THE INVENTION

In Swedish patent applications 75 10559-3, 7607337-8 and 7510558-5 which correspond to U.S. application Ser. No. 720,122 filed Sept. 3, 1976, Ser. No. 805,520 filed June 10, 1977, and Ser. No. 720,734 filed Sept. 7, 1976 now U.S. Pat. No. 4,088,368, issued May 9, 1978, respectively, are described methods for breaking a hard material, especially rock, by means of relatively incompressible fluid, such as water. The object of the present invention is to provide improved means for making use of the hydraulic breaking technique described in these applications.

More specifically, one object of the invention is to achieve a method and apparatus where the momentum required for breakage is obtained by adding the momentum of at least two fluid mass bodies before these bodies impact the material. This feature makes it possible to use light units which can be handled by one man.

Another object of the invention is to facilitate alignment of the gun barrel with the hole.

A further object of the invention is to achieve a method and apparatus wherein it is possible to vary the momentum delivered into a hole and wherein delivery of explosives is facilitated.

The invention is described in the following description with reference to the accompanying drawings in which various embodiments are shown by way of example. It is to be understood that these embodiments are only illustrative of the invention and that various modifications thereof may be made within the scope of the claims following hereinafter.

DETAILED DESCRIPTION OF PREFERRED EMBODIMENTS

Figure 1:
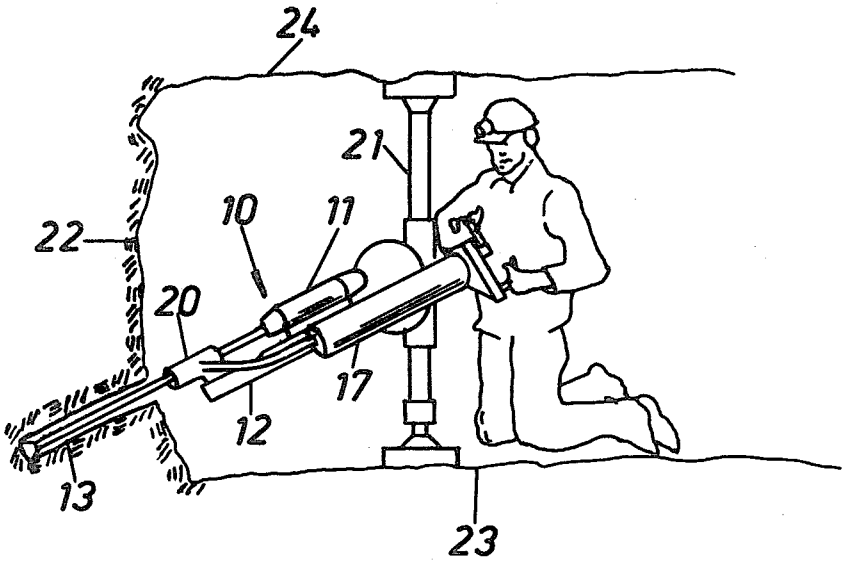
FIG. 1 shows a side view of one embodiment of an apparatus according to the invention.

Corresponding details have been given the same reference numeral in the various figures.

In FIG. 1 is shown an apparatus generally depicted 10 for breaking a hard material, such as rock. The apparatus comprises a rock drilling machine 1 which is mechanically fed along a feed bar 12. A cylindrical blind hole 13 is drilled in conventional manner by means of a drill rod 14 and drill bit 15.

The feed bar 12 carries also two energy generators or guns 16, 17. The guns 16, 17 are designed to accelerate mass bodies of relatively incompressible fluid, such as water, through pipes 18, 19. The pipes 18, 19 terminate into a barrel 10. The sum of the inner area $A_1$ of the pipes 18, 19 is substantially equal with the free cross section area of the barrel 20, see FIG. 3. It is thereby safeguarded that the fluid fills the entire inner section of the barrel 20 so as to form a coherent longish mass body. By free cross section area is meant the inner area $A_2$ of the barrel 20 minus the area $A_3$ of the drill rod 14. The apparatus 10 is swingably carried by an extension column 21 so as to permit arbitrarily drilling in a surface 22 of the material to be broken. The column 21 is jacked up between the floor 23 and the roof 24.

Figure 3:
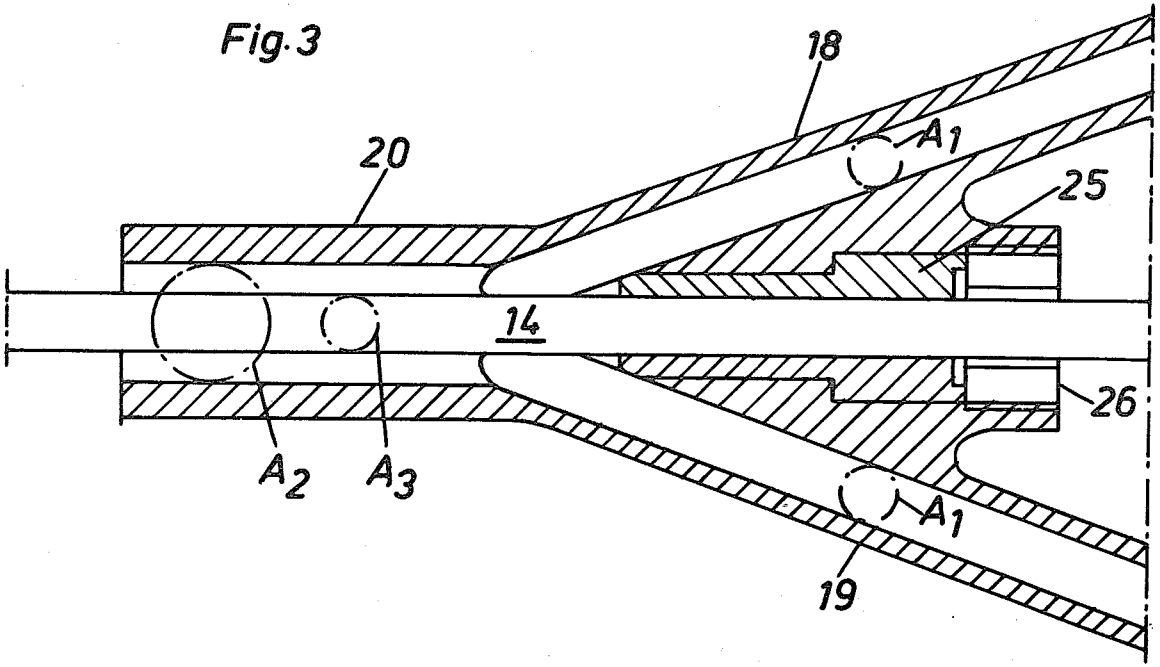
FIG. 3 is a section on line III—III in FIG. 2.

As shown in FIG. 3 is the drill rod 14 centralized by means of a bushing 25 which is located in the rear portion of the connection between the barrel 20 and the pipes 18, 19. In order to facilitate its mounting is the bushing 25 preferably made in two pieces. The bushing 25 is secured by means of a lock screw 26.

If it is desired to centralize the drill rod 14 nearer to the drill hole may the bushing 25 be prolonged forwards such that it extends through the barrel 20. In this case must the prolonged bushing be withdrawn before actuation of the gun so that it uncovers the mouths of the pipes 18, 19. Preferably, the withdrawal is carried out pneumatically or hydraulically.

If preferred can the drill bit of course be withdrawn rearwardly of the mouths of the pipes 18, 19, see FIG. 3, before launching the fluid. In this case should the sum of the areas $A_1$ be equal with the area $A_2$.

The breakage process which occurs when the mass body is directed into the hole 13 to impact a surface therein is in detail described in the Swedish patent applications 75 10559-3 (corresponding to U.S. Ser. No. 720,122) and 76 07337-8 (corresponding to U.S. Ser. No. 805,520). Shortly, cracks 28 are caused to form in the material by means of the pressure pulse which arises in the mass body when same impacts a surface in the hole 13. The formed cracks are driven further, indicated by 29 in FIG. 2, towards the free surface 22 of the material. In these applications is also stated how the area ratio between the mass body and the hole affects the breakage process, and that it has been found that an optimum breakage is obtained if the mass body is given a free cross section area which is substantially equal with the free cross section area of the hole.

In Swedish patent application 7607337-8 (U.S. Ser. No. 805,520) is further stated that a condition which must be fulfilled in order to obtain accurate breakage is that the fluid mass body is to be caused to impact the material at a required momentum.

In the underground breaking where the space is narrow it is often necessary that each separate part of the breaking apparatus can be easily handled by one man. The weight of one gun 16, 17 should therefore be of substantially the same magnitude as the weight of the rock drilling machine 11. The momentum which can be generated by one light unit, however, may be insufficient for obtaining breakage in some cases where burden, hole spacing and hole depth are chosen with respect to economic demands. This problem is solved by firing two (or more) guns 16, 17 simultaneously and by transforming the mass bodies which are accelerated by each of the guns into a single mass body inside the barrel 20.

Figure 2:
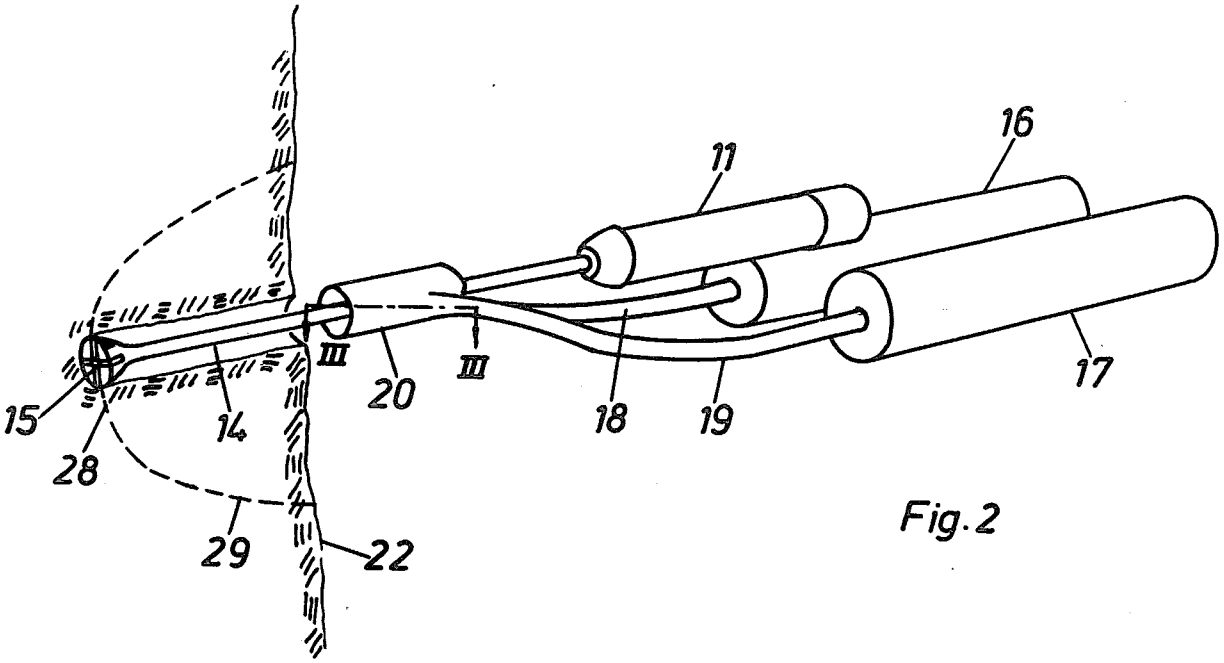
FIG. 2 shows diagrammatically an enlarged perspective side view of the apparatus in FIG. 1.

In the apparatus shown in FIGS. 1–3 are the drill rod 14 and drill bit 15 retained in the hole 13 during the breaking process. That means that the mass body in the barrel 20 is aligned with the hole 13 by means of the drill rod and bit. The process is thereby speeded up.

Further, it is possible to speed up the process even more by drilling and launching simultaneously. By suitable design of the drill bit 15 can the mass body be deflected laterally so as to obtain directed fracture. The theory of directed fracture is described in the Swedish patent application 75 10559-3 (U.S. Ser. No. 720,122).

The advantage of using the drill rod and bit as aligning means for aligning the gun barrel is of course the same in an apparatus where only a single fluid gun is fired.

Figure 4:
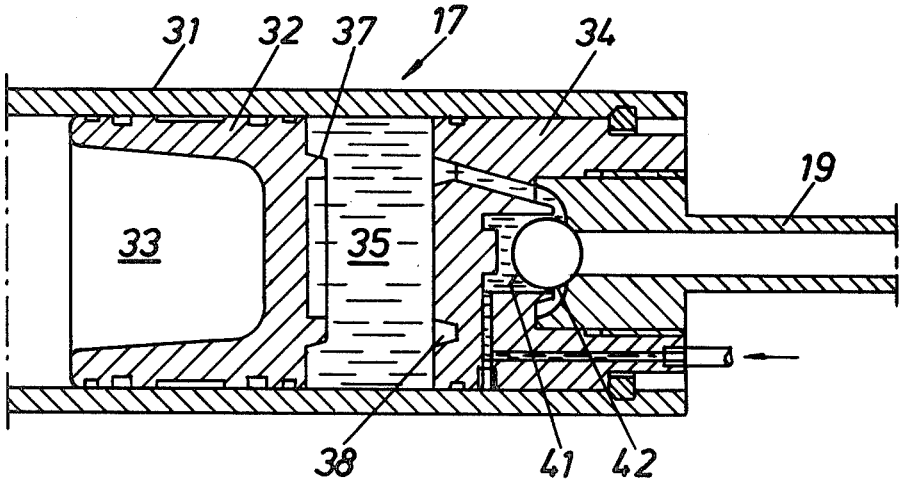
FIG. 4 shows in section an energy generator in an apparatus according to the invention ready for "shot"
Figure 5:
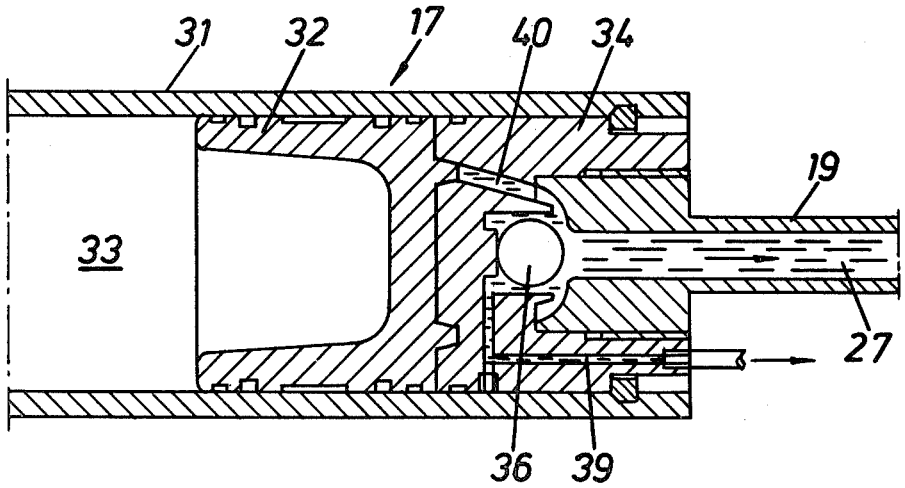
FIG. 5 shows the energy generator in FIG. 4 after a "shot".

In FIGS. 4 and 5 is shown a gun or energy generator 16, 17 for launching fluid in form of a fluid column into the hole 13. The gun 17 comprises a cylinder 31 and a drive piston 32 which is reciprocable within the cylinder 31. The drive piston 32 and a back head, not shown, confine a rear cylinder chamber 33.

A front head 34 and the drive piston 32 confine a forward cylinder chamber 35. A barrel or pipe 19 is connected to the front head 34.

The drive piston 32 is provided with an annular protrusion 37 which is adapted to cooperate with a mating recess 38 in the front head 34 so as to hydraulically retard the drive piston during the end of its stroke.

The forward cylinder chamber 35 provides a storage chamber for the fluid before the fluid is admitted into the pipe 19. The fluid is supplied to the storage chamber 35 through passages 39, 40 in the front head 34. A ball valve 36 controls the fluid flow to and from the storage chamber 35.

The rear cylinder chamber 33 is charged with compressed gas, such as pressure air. The compressed gas acts upon the drive piston 32 which transmits this thrust load to the fluid in the storage chamber 35.

When fluid is supplied through the passage 39 the fluid pressure acts upon a holding surface 41 on the valve body 36. The valve body is then shifted to the position shown in FIG. 4. In this position is the outlet passage through the pipe 19 shut off. The fluid flows past the ball valve 36 around its periphery through the passage 40 into the storage chamber 35.

The gun 17 is fired by reversing the fluid flow through the passage 39. The fluid pressure in the storage chamber 35 acts upon a holding surface 42 on the ball valve 36, thereby shifting same to the position shown in FIG. 5. The fluid in the chamber 35 is now forced through the passage 40 into the pipe 19 where it is accelerated as a coherent mass body 27. During the propulsion of the fluid through the pipe 19 a small leakage flow occurs through the "inlet" passage 39.

Due to the fact that the gun 17 is triggered by the described reversing of the fluid flow may the amount of fluid in chamber 35 and the gas pressure in chamber 33 and thus the momentum delivered into the hole be varied continuously within certain limits.

In order to maximize the momentum should the length of the mass body when same impacts the hole bottom preferably be as long as possible, i.e. the sum of the hole depth and the length of barrel and pipe. For a given value of the weight of the mass body may the momentum be further increased by loading the chamber 33 by a gas having a higher initial pressure.

When two or more mass bodies are transformed into a single mass body it is important that the separate guns are triggered substantially simultaneously. By using a gun of the type shown in FIGS. 4 and 5 such triggering is safeguarded since the inlet passages 39 can be connected to a common control valve.

Figure 6:
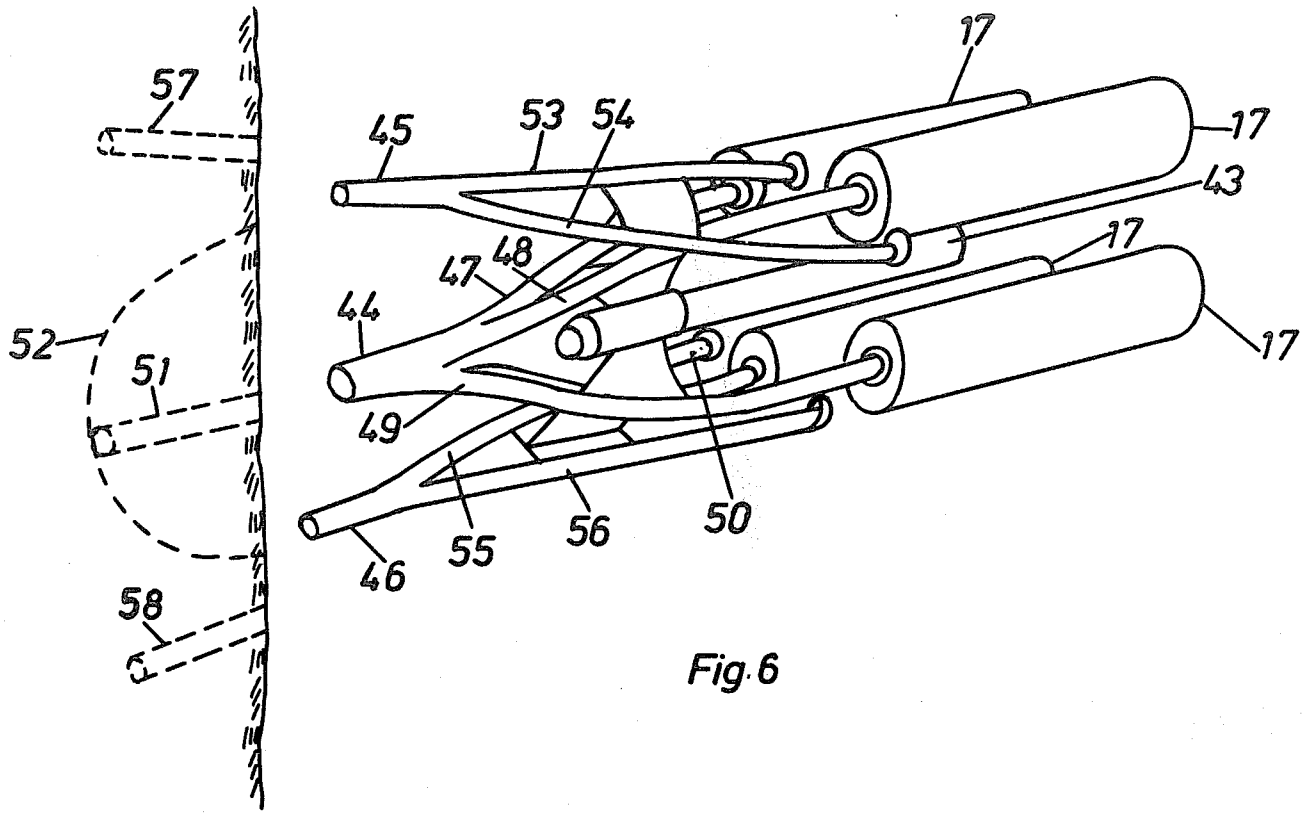
FIG. 6 shows diagrammatically a perspective side view of another embodiment.

FIG. 6 illustrates another embodiment of a breaking machine according to the invention. This machine comprises four guns or energy generators 17 and three barrels 44,45,46. The intermediate barrel 44 is branched rearwards into four pipes 47,48,49,50. The barrels 45, 46 are each branched rearwards into two pipes 53, 54 and 55, 56, respectively. The pipes 47–50, 53–56 are rigidly connected to each other and are turnable about a longitudinal axle 43. In one turning position of the pipes are the pipes 47–50 connected to the guns 17. In this case is the momentum of four mass bodies added when they are transformed into a single mass body in the barrel 44 and launched into a pre-drilled hole 51. When the material around the hole 51 is broken are free surfaces created, indicated by broken lines 52 in FIG. 6.

In another turning position of the pipes are two guns connected to barrel 45 and the other two are connected to barrel 46. The guns connected to the same barrel are triggered simultaneously and mass bodies are driven into holes 57,58. The momentum supplied to the holes 57,58 is only half of that supplied to the hole 51. Breakage occurs, however, since the created cracks have to be driven only to the free surface 52 which means that less breaking energy is required. The inner area of the barrels should preferably be substantially the same as the sum of the inner area of the corresponding branching pipes.

Figure 7:
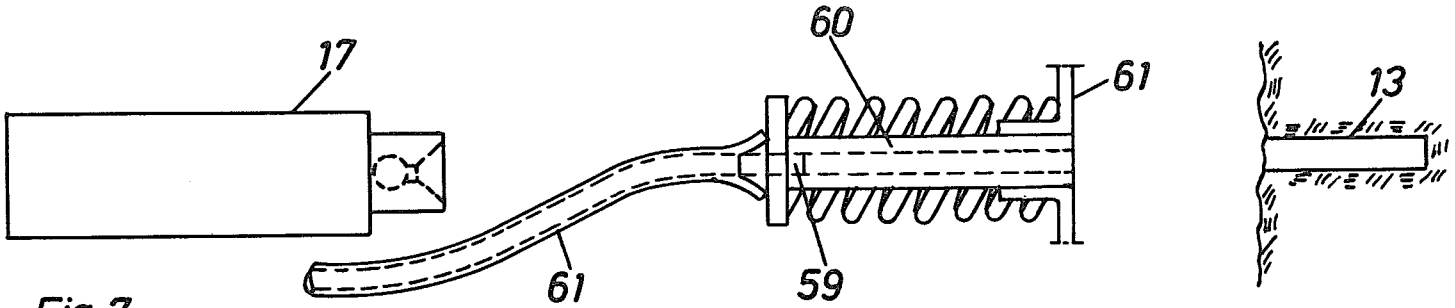
FIG. 7 shows diagrammatically a side view of a further embodiment in a loading position.
Figure 8:
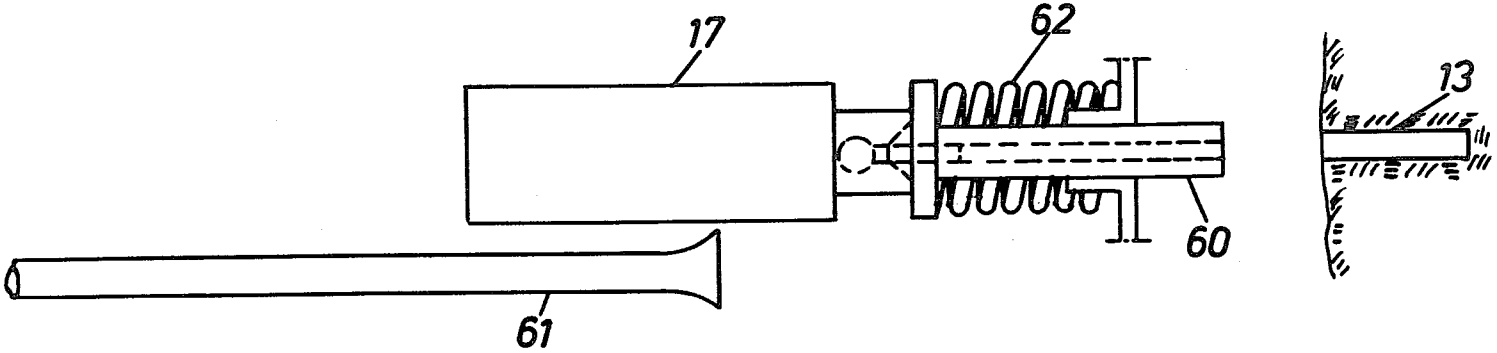
FIG. 8 shows the apparatus in FIG. 7 in a "shooting" position.

FIGS. 7 and 8 show a further embodiment of an apparatus according to the invention. This apparatus is designed to launch simultaneously an explosive 59 and a fluid mass body into the hole 13. When the fluid and the explosive impact the hole bottom is the explosive initiated. After the detonation the fluid stems the hole thereby preventing detonation gases from leaking out of the hole before breakage is completed. This breakage process is in detail described in Swedish patent application 75 10558-5 (corresponding to U.S. Pat. No. 4,088,368).

The main characterizing feature of the apparatus according to FIGS. 7 and 8 is that the gun 17 and the barrel 60 are designed as separable units which can be connected and disconnected. This feature facilitates the loading of the explosive 59 into the barrel 60. FIG. 7 shows the apparatus in a loading position. The explosive 59 is delivered into the barrel 59 through a conduit 61. The explosive is prevented from passing freely through the barrel by suitable means, not shown, such as an inwardly extending rib in the rear end of the barrel.

When the explosive has been inserted into the barrel the explosive-delivery conduit 61 is retracted, see FIG. 8. The gun 17 is moved against the barrel 60. The barrel 60 is pushed forward through the module gable 61 by the gun 17 against the effect of a spring 62. The gun 17 is then ready to be fired.

In accordance with the invention, the fluid in the form of a water body is preferably accelerated to a velocity in the order of from 100 to 300 meters/sec. The mass body is preferably given a length of from about 0.2 to 2.0 meters, and a cross sectional diameter of between 70–100% of the free cross sectional diameter of the hole. In a further preferred embodiment, the mass body as a cross sectional diameter of more than 90% of the free cross sectional diamter of the hole.

What I claim is:

1. A method of breaking hard compact material, such as rock, comprising: driving at least two longish mass bodies of relatively incompressible fluid, such as water, toward the material to be broken to impact a surface thereon, and transforming said at least two mass bodies into a single mass body prior to the impact against said material, thereby adding the momentum of each of said at least two mass bodies.

2. A method according to claim 1, comprising accelerating said single mass body in the form of a water body to a velocity in the order of from 100 to 300 meters/sec.

3. A method according to claim 1, comprising giving said single mass body a length of from 0.2 to 2.0 meters.

4. A method according to claim 1, comprising triggering the driving of said at least two longish mass bodies substantially simultaneously.

5. A method according to claim 1, wherein said single mass body is directed into a cavity in the material for impacting a surface therein.

6. A method according to claim 5, wherein said single mass body is directed into said cavity for impacting the bottom of said cavity.

7. A method according to claim 5, comprising at least partially deflecting said single mass body laterally in said cavity for impacting a portion of the wall of said cavity.

8. A method according to claim 5, comprising giving said single mass body a cross-sectional diameter of between 70–100% of the free cross-sectional diameter of said cavity.

9. A method according to claim 5, wherein cracks are caused to form in the material by means of the pressure pulse which arises in said single mass body when same impacts said surface.

10. A method according to claim 9, wherein said formed cracks are driven further by the effect of the added momenta.

11. A method according to claim 5, wherein said single mass body is directed into a pre-drilled hole.

12. A method according to claim 11, wherein said single mass body is directed into said pre-drilled hole for impacting the bottom of said hole.

13. A method according to claim 5, comprising giving said single mass body a cross-sectional diameter of more than 90% of the free cross-sectional diameter of said cavity.

14. A method according to claim 13, comprising giving said single mass body a cross-sectional diameter which is substantially equal to said free cross-sectional diameter of said cavity.

15. A method of breaking hard compact material, such as rock, comprising: accelerating at least two longish mass bodies of relatively incompressible fluid, such as water, spaced from the material to be broken, generating the momentum which is required for breakage by bringing said at least two mass bodies into a single mass body so as to add the momentum of each of said at least two mass bodies, and directing said single mass body into a cavity in the material to be broken for impacting a surface therein.

16. A method according to claim 15, comprising directing said single mass body into said cavity for impacting the bottom of said cavity.

17. A method according to claim 15, comprising accelerating said at least two mass bodies in the form of water bodies such that said single mass body has a velocity in the order of from 100 to 300 meters/sec.

18. A method according to claim 15, comprising at least partially deflecting said single mass body laterally in said cavity for impacting a portion of the wall of said cavity.

19. A method according to claim 15, comprising giving said single mass body a length of from 0.2 to 2.0 meters.

20. A method according to claim 15, comprising giving said single mass body a cross-sectional diameter of between 70–100% of the free cross-sectional diameter of said cavity.

21. A method according to claim 15, comprising triggering the acceleration of each of said at least two mass bodies substantially simultaneously.

22. A method according to claim 15, comprising giving said single mass body a cross-sectional diameter of more than 90% of the free cross-sectional diameter of said cavity.

23. A method according to claim 22, comprising giving said single mass body a cross-sectional diameter which is substantially equal to said free cross-sectional diameter of said cavity.

24. A method of breaking hard compact material, such as rock, by means of relatively incompressible fluid, such as water, comprising: pre-drilling at least one hole in the material to be broken, causing a longish mass body of the fluid to impact a surface in one of said at least one hole at such momentum that the material is broken, generating the momentum which is required for breakage by (a) accelerating at least two longish mass bodies of the fluid, said mass bodies being spaced from the material, and (b) transforming said at least two mass bodies into a single mass body so as to add the momentum of each of said at least two mass bodies, and directing said single mass body into said one hole for impacting said surface.

25. A method according to claim 24, wherein said at least two mass bodies are accelerated to an impact velocity of sufficient magnitude for causing cracks to form in the material, said formed cracks being driven further by the effect of the added momenta.

26. A method according to claim 24, comprising causing said longish mass body of fluid to impact the bottom of said at least one hole.

27. A method according to claim 24, comprising accelerating the fluid in the form of a water body to a velocity in the order of from 100 to 300 meters/sec.

28. A method according to claim 24, comprising at least partially deflecting said single mass body laterally in said hole for impacting a portion of the wall of said hole.

29. A method according to claim 24, comprising giving said single mass body a length of from 0.2 to 2.0 meters.

30. A method according to claim 24, comprising giving said single mass body a cross-sectional diameter of between 70–100% of the free cross-sectional diameter of said hole.

31. A method according to claim 24, comprising triggering the acceleration of each of said at least two mass bodies substantially simultaneously.

32. A method according to claim 24, comprising giving said single mass body a cross-sectional diameter of more than 90% of the free cross-sectional diameter of the hole.

33. A method according to claim 32, comprising giving said single mass body a cross-sectional diameter which is substantially equal to said free cross-sectional diameter of the hole.

34. A method of breaking hard compact material, such as rock, by means of relatively incompressible fluid, such as water, comprising: drilling a hole in the material to be broken with a drill rod and drill bit, retaining the drill rod and drill bit in the drilled hole, accelerating a longish fluid mass body to a velocity of sufficient magnitude for generating a momentum required for breakage, and directing said longish fluid mass body into said hole around said drill rod to impact a surface in the hole to create pressure for breaking the material.

35. A method according to claim 34, comprising accelerating the fluid in form of a water body to a velocity in the order of from 100 to 300 meters/sec.

36. A method according to claim 34 comprising at least partially deflecting the mass body laterally in said hole for impacting a portion of the wall of the hole.

37. A method according to claim 34 comprising giving the mass body a length of from 0.2 to 2.0 meters.

38. A method according to claim 34, comprising giving the mass body a cross section diameter of between 70–100% of the free cross sectional diameter of the hole.

39. A method according to claim 34, comprising giving the mass body a cross sectional diameter of more than 90% of the free cross sectional diameter of the hole.

40. A method according to claim 34, comprising aligning said fluid mass body with said hole by means of said drill bit and rod.

41. A method according to claim 40, comprising simultaneously drilling said hole and launching said mass body into the hole.

42. A method according to claim 34, comprising generating the momentum which is required for breakage by accelerating at least two mass bodies of the fluid outside the hole and directing said at least two mass bodies into the hole.

43. A method according to claim 42, comprising transforming said at least two mass bodies into a single mass body so as to add the momentum of each of said at least two mass bodies before directing said single mass body into said hole.

44. A method according to claim 42 comprising triggering the acceleration of each of said at least two mass bodies substantially simultaneously.

45. A method of breaking hard compact material, such as rock, by means of relatively incompressible fluid, such as water, comprising driving a longish mass body of fluid along an acceleration track which comprises an elongated barrel, connecting said elongated barrel to an energy generator prior to the driving of said mass body, directing said mass body into a pre-drilled hole in the material through said barrel for impacting a surface therein, and transforming at least two mass bodies of said fluid into said longish mass body prior to directing said longish mass body into the hole.

46. A method according to claim 45, comprising delivering an explosive to a position substantially in line with said barrel before connecting said energy generator and barrel.

47. A method according to claim 46, comprising delivering said explosive into the end of said barrel which faces said energy generator.

48. An apparatus for breaking hard compact material, such as rock, wherein the material is broken by means of relatively incompressible fluid, such as water, which is directed toward the material to be broken, comprising at least two separate energy generators (16,17), a storage chamber (35) for storing the fluid in each of said at least two energy generators, forcing means (32,33) for exerting a thrust force upon the fluid in said storage chambers in order to accelerate the fluid in the respective chamber in the form of a mass body (27), means (20) for transforming the at least two mass bodies into a single mass body so as to add the momentum of each of said at least two mass bodies in order to obtain an overall momentum required for breakage, and means (12, 21) for directing said single mass body toward a surface on said material.

49. An apparatus according to claim 48, wherein said fluid mass body is made of water and has a length of from 0.2 to 2.0 meters when impacting the material and is given an impact velocity in the order of 100 to 300 meters/sec. by means of said forcing means.

50. An apparatus according to claim 48 comprising means for triggering the acceleration of each of said at least two mass bodies substantially simultaneously.

51. A device according to claim 48, comprising adjusting means for directing the single mass body toward a cavity in the material.

52. A device according to claim 51, wherein said cavity comprises a pre-drilled hole in said hard compact material.

53. An apparatus according to claim 48, wherein said fluid mass body is given a cross sectional diameter of between 70–100% of the free cross sectional diameter of said hole.

54. An apparatus according to claim 53, wherein said fluid mass body is given a cross sectional diameter of more than 90% of the free cross sectional diameter of said hole.

55. An apparatus according to claim 54, wherein said fluid mass body is given a cross-sectional diameter which is substantially equal to said free cross-sectional diameter of said hole.

56. An apparatus according to claim 48, wherein said directing means comprises at least one barrel (44,45,46,60) which is capable of being connected and disconnected, respectively, to an energy generator (17), and comprising connecting means for connecting said energy generator to said barrel before the mass body is directed toward the material.

57. An apparatus according to claim 56, comprising an inlet passage (39,40) for supplying fluid to a storage chamber (35) in an energy generator (17), an outlet passage (40) for admitting fluid into said barrel from said storage chamber, a valve body (36), said valve body when in one position allowing fluid to flow to the storage chamber from the inlet passage and at the same time with closing the connection between the storage chamber (35) and the barrel (19), said valve body further being shiftable to open the connection between the storage chamber (35) and the barrel (19), the position of the valve body being responsive to the direction of the fluid flow such that the valve body is shifted by reversing the fluid flow through the inlet passage (39).

58. An apparatus according to claim 56, comprising explosive delivery means (61) for delivering an explosive (59) to a position substantially in line with said barrel before the connection of said energy generator and barrel.

59. An apparatus according to claim 56, comprising means for transforming at least two mass bodies into a single body prior to the driving thereof toward the material.

60. An apparatus according to claim 59, comprising explosive delivery means (61) for delivering an explosive (59) to a position substantially in line with said barrel before the connection of said energy generator and barrel.

61. An apparatus according to claim 60, wherein said explosive delivery means is adapted to deliver the explosive into the end of said barrel which faces said energy generator.

62. An apparatus for breaking hard compact material, such as rock, by means of relatively incompressible fluid, such as water, which is directed toward the material to be broken, comprising means (11, 14, 15) for drilling a hole (13) in the material, means (32, 33) for driving the fluid in form of a longish mass body (27) into said hole, said driving means applying to said fluid mass body a momentum sufficient for causing cracks (28, 29) to form in the material upon impacting therebetween, and means (20) for forming said mass body into an annular column around the drill rod (14) and directing said annular column into said hole.

63. An apparatus according to claim 62, comprising at least two separate energy generators (16, 17), a storage chamber (35) for storing the fluid in each of said at least two energy generators, means (32, 33) for exerting a thrust load upon the fluid in said storage chambers in order to accelerate the fluid in a respective chamber in the form of a mass body (27), and means (20) for transforming the at least two mass bodies into a single mass body as as to add the momentum of each of said at least two mass bodies, said directing means being adapted to direct said single mass body into said hole around said drill rod.

64. An apparatus according to claim 62, wherein said driving means comprises means for generating at least two mass bodies of said relatively incompressible fluid and for driving the at least two mass bodies of fluid towards said hole, and means for combining the at least two mass bodies of fluid into a single mass body so as to add the momentum of each of said at least two mass bodies, said directing means directing said single mass body into said hole around said drill rod.

65. A method of breaking a hard compact material by means of a relatively incompressible fluid, using an energy accumulator which has a fluid storage chamber, comprising drilling a hole, directing a closed outlet conduit of the storage chamber into the hole, supplying fluid to the storage chamber of the energy accumulator through an inlet passage and a valve, reversing the fluid flow through said inlet passage to thereby shift the valve from a closed position where it closes the outlet conduit of the storage chamber to an open position where it opens the outlet conduit of the storage chamber so that a fluid column is ejected from the storage chamber and is directed into said hole through said outlet conduit so that the fluid column will impact a surface in the hole and build up a pressure therein that is sufficient for breaking the material.

66. A method according to claim 65, wherein said outlet conduit of the storage chamber comprises an acceleration track within which the fluid column is accelerated.

67. A method according to claim 65, comprising directing said mass body into said hole for impacting the bottom of said hole.

68. A method according to claim 65, comprising retaining said valve body in its position where the outlet passage is closed by means of the pressure in the inlet passage.

69. A method according to claim 68, comprising shifting said valve body to its position where the outlet opening is open by unloading said valve body from the pressure in the inlet passage.

70. A method according to claim 69, comprising causing the fluid to flow through both the inlet passage and the outlet passage upon shifting of said valve body.

* * * * *

UNITED STATES PATENT AND TRADEMARK OFFICE

CERTIFICATE OF CORRECTION

PATENT NO. : 4,204,715

DATED : May 27, 1980

INVENTOR(S) : Erik V. LAVON

It is certified that error appears in the above-identified patent and that said Letters Patent are hereby corrected as shown below:

Column 8 (claim 59), line 67, change "single body" to --single mass body--.

Signed and Sealed this

*Twenty-ninth* Day of *July 1980*

[SEAL]

*Attest:*

SIDNEY A. DIAMOND

*Attesting Officer*

*Commissioner of Patents and Trademarks*